US007024915B2

(12) United States Patent
Ferrari et al.

(10) Patent No.: US 7,024,915 B2
(45) Date of Patent: Apr. 11, 2006

(54) TOOL HOLDER UNIT FOR BENDING BRAKES

(75) Inventors: Fabrizio Ferrari, Traversetolo (IT); Claudio Mattioli, Basilicanova (IT)

(73) Assignee: Ferrari Costruzioni Meccaniche S.R.L., Basilicanova (IT)

( * ) Notice: Subject to any disclaimer, the term of this patent is extended or adjusted under 35 U.S.C. 154(b) by 189 days.

(21) Appl. No.: 10/716,633

(22) Filed: Nov. 20, 2003

(65) Prior Publication Data

US 2005/0081596 A1 Apr. 21, 2005

(30) Foreign Application Priority Data

Oct. 20, 2003 (IT) ..... RE2003A0101

(51) Int. Cl.
*B21D 37/00* (2006.01)

(52) U.S. Cl. ..... 72/482.2; 72/482.6

(58) Field of Classification Search ..... 72/481.1, 72/482.1, 482.2, 482.3; 83/482, 698.11, 83/698.71, 699.31, 954, 481; 483/65, 16; 409/163, 189, 197, 205, 204, 232, 234
See application file for complete search history.

(56) References Cited

U.S. PATENT DOCUMENTS

2002/0053231 A1* 5/2002 Tarasconi ..... 72/482.2
2003/0019272 A1 1/2003 Harrington et al.

FOREIGN PATENT DOCUMENTS

EP 0 767 015 A 4/1997
EP 1 199 113 A 4/2002
EP 1 213 062 A 6/2002

* cited by examiner

*Primary Examiner*—Derris H. Banks
*Assistant Examiner*—Teresa M. Bonk
(74) *Attorney, Agent, or Firm*—Browdy and Neimark, PLLC

(57) ABSTRACT

A toolholder unit for sheet metal bending brakes, comprising a bar to be associated with a fixed or movable part of the brake, and provided with at least one recess forming with a jaw associated therewith a groove to receive the shank of the tool, there being provided elastic means to maintain said jaw spaced from said recess and from the shank contained therein, and locking means to clamp said jaw against said shank, said locking means comprising: at least one slider axially slidable within a seat facing that side of the bar facing the jaw; at least one appendix projecting from said slider beyond that side of the bar facing the jaw; at least one cavity provided in the bar, or in a part rigid with it, to receive said appendix; and means of variable profile to cause said slider to undergo controlled translations relative to said bar.

10 Claims, 6 Drawing Sheets

TOOL HOLDER UNIT FOR BENDING BRAKES

FIELD OF THE INVENTION

The present invention relates in a totally general sense to presses for bending sheet metal, and more particularly to a fixing unit for the relative tools.

For such work, bending brakes are known essentially comprising a bed and a crosspiece which are positioned respectively below and above a work station, and of which at least one is movable vertically.

The bed carries a first tool, usually of female type, known as the die, the crosspiece carrying a second tool, usually of male type, known as the punch.

The mutual position of the die and punch can be inverted with respect to the aforestated on the basis of particular operative requirements.

Said die and said punch are of modular or sectional type, i.e. they comprise a series of sectors which can be fitted together to achieve the required working or bending length.

For reasons of simplicity, express reference will be made hereinafter to the tool of punch type, which will be considered to be associated with the crosspiece, for example movable, of the brake, it being also understood that that to be stated is valid practically in total for the underlying tool of die type.

The punch is known to be removably fixed to the crosspiece by way of a robust bar usually known as the adaptor.

The adaptor is lowerly provided with a full-length groove of constant right-angled cross-section, to receive the fixing shank of the tool.

Said adaptor is provided with fixing means acting transversely on the shank and arranged to assume two configurations, namely a rest and working configuration, corresponding to locking and to release of the shank respectively.

Said fixing means are operated manually with the aid of a lever implement which is removably associated with the adaptor.

The use of said lever has proved unsatisfactory at least for the following reasons.

Firstly, if inadvertently left on the adaptor, the lever can constitute a serious source of danger for operators in that it projects inconveniently beyond the outline of the adaptor.

Secondly, said lever is hardly practical, seeing that at each tool change and/or adjustment it has to be engaged with and then removed from said fixing means.

It can also happen, as indeed it has already happened, that the lever, once detached from the fixing means, is randomly left in an inadequate or unusual place, possibly together with materials and parts foreign to the operation underway, with the result that its finding is bothersome and represents a loss of time.

SUMMARY OF THE INVENTION

The main object of the present invention is to provide a toolholder unit able to overcome the aforesaid problems within the context of a simple, rational, reliable, economical and practical construction of small overall size.

The characteristics and constructional merits of the invention, together with its method of operation, will be apparent from the ensuing detailed description given with reference to the figures of the accompanying drawings, which illustrate a particular preferred embodiment thereof by way of non-limiting example.

DESCRIPTION OF THE PREFERRED EMBODIMENT

Figure 1:
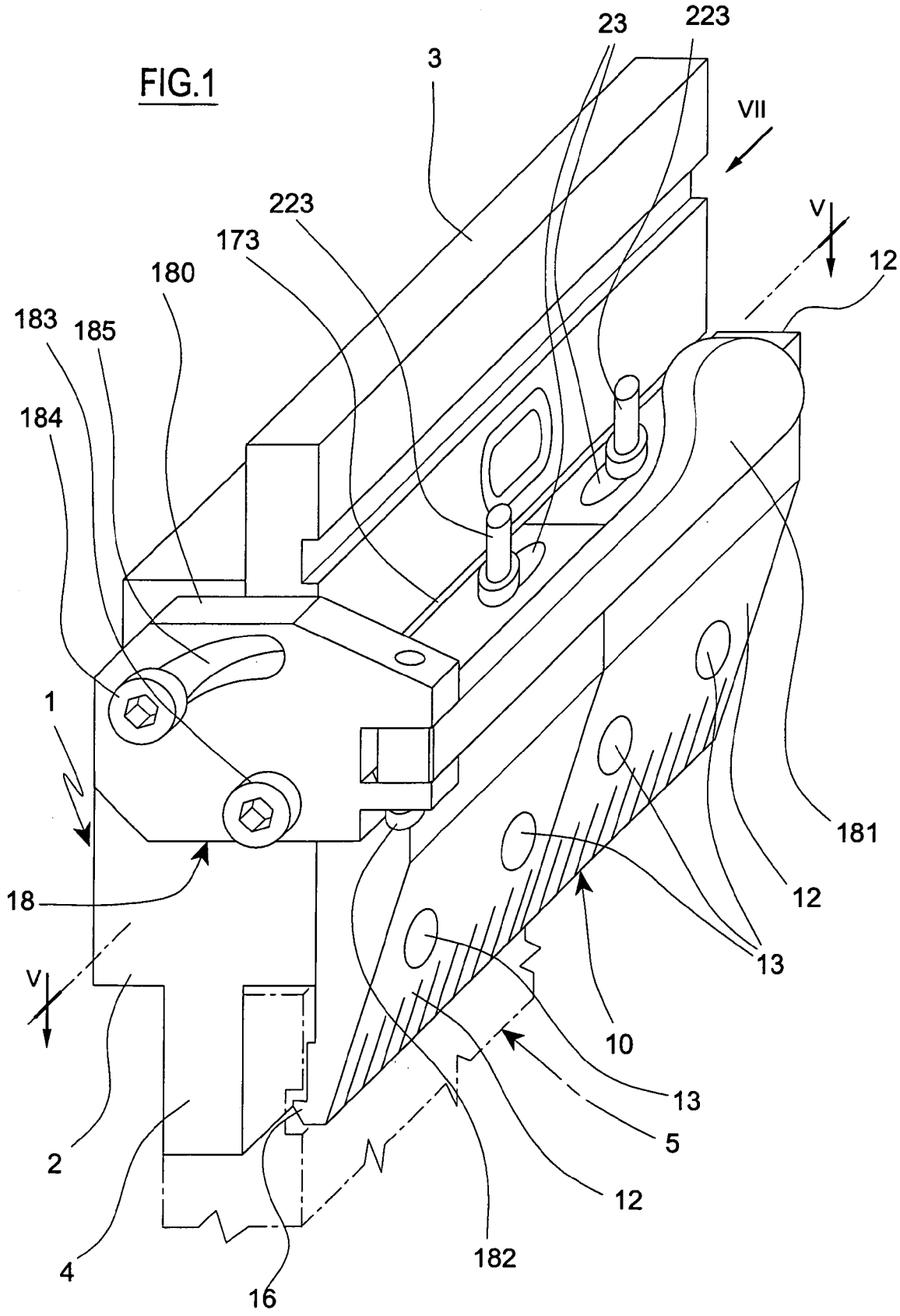
FIG. 1 is a perspective view showing the unit assembled.
Figure 2:
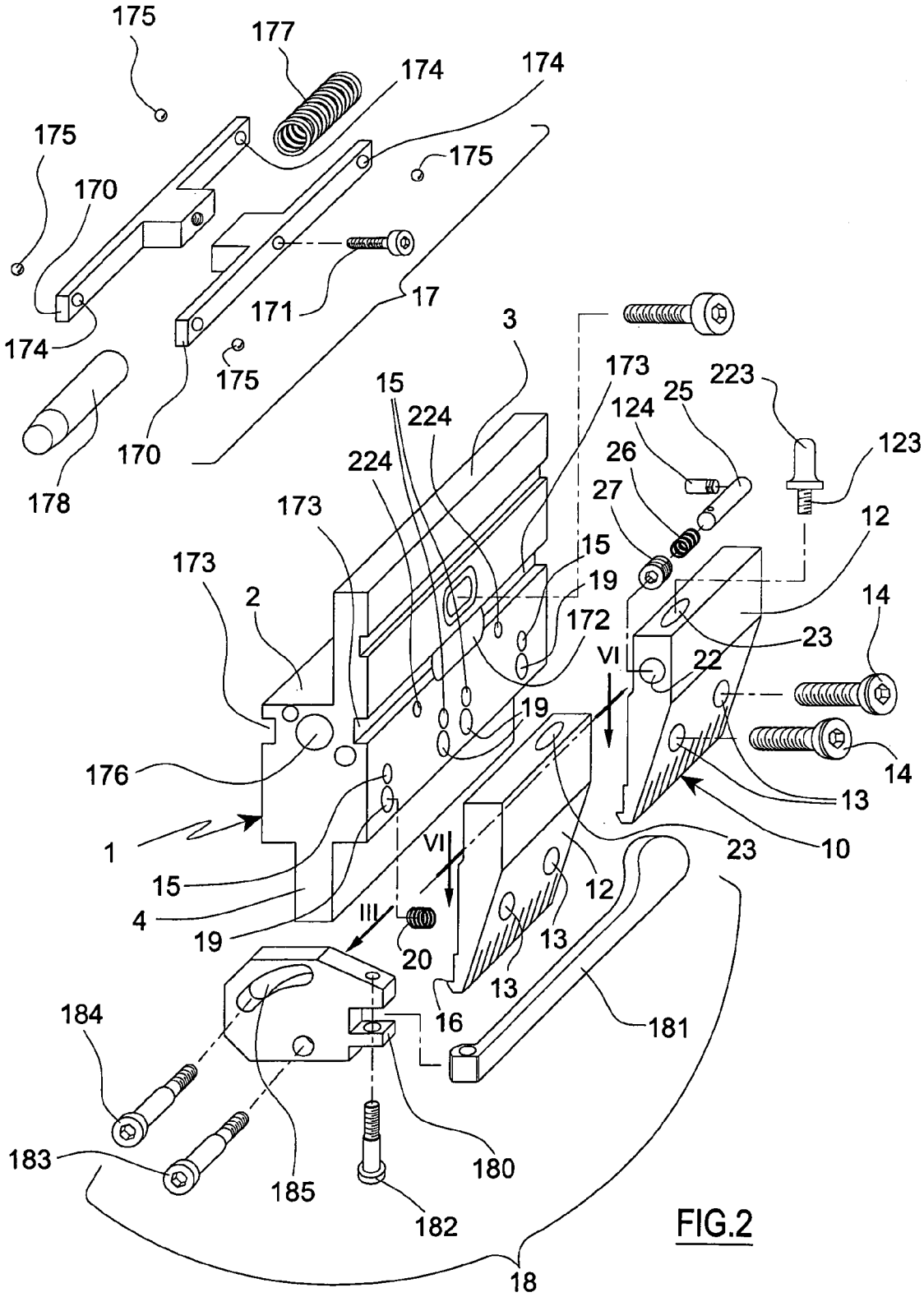
FIG. 2 shows the same unit in exploded view, with some parts omitted for reasons of clarity and simplicity.

Said figures, and in particular FIGS. 1 and 2, show a bar 1, usually known as an adaptor, to be installed on a sheet metal bending brake, not shown for reasons of simplicity, and fixed thereto in known manner.

In the illustrated example, the bar 1 is intended to be associated with the usually vertically movable crosspiece of said brake.

Figure 7:
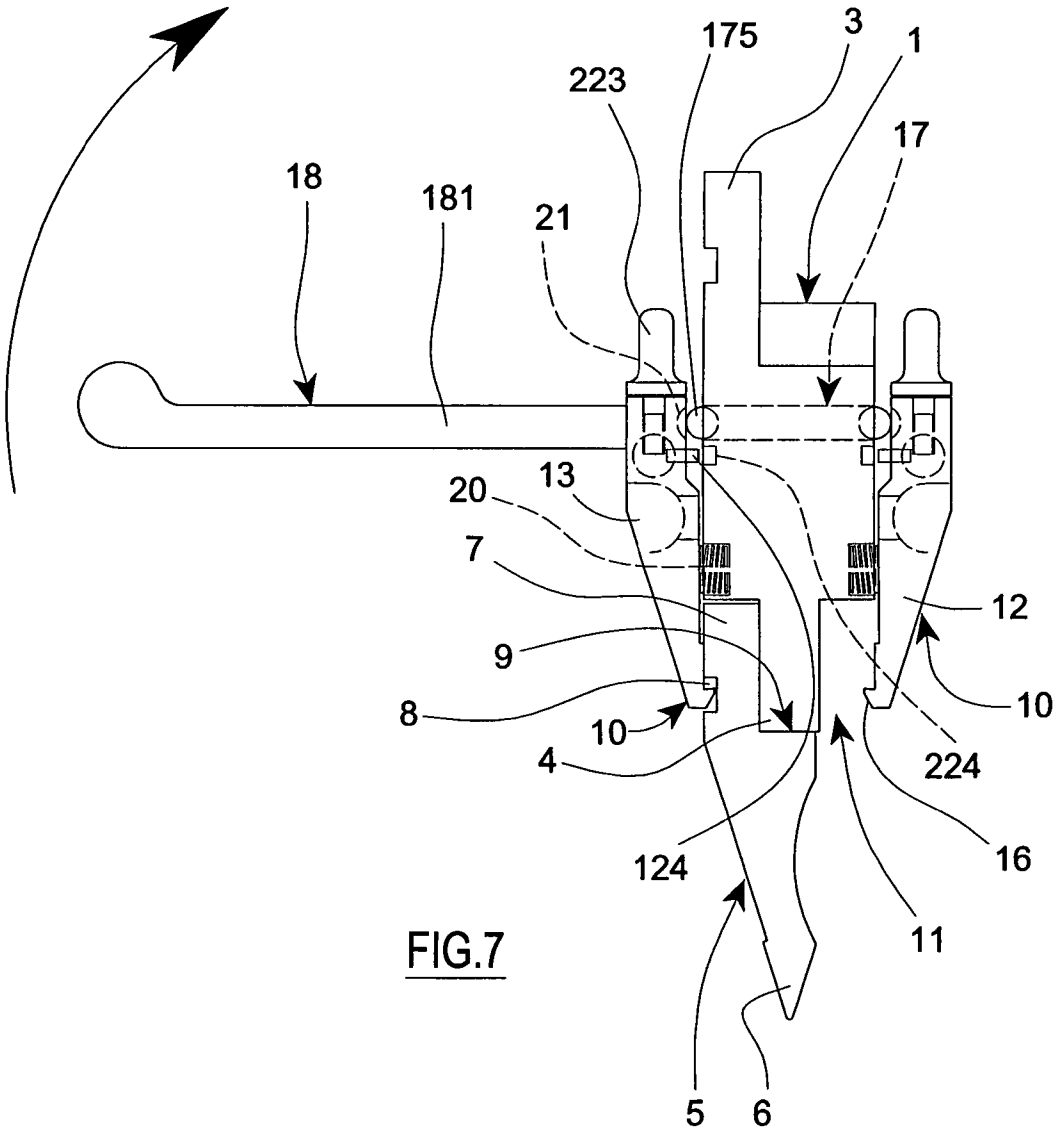
FIG. 7 is the view obtained in the direction VII indicated in FIG. 1, in a different operative configuration.
Figure 8:
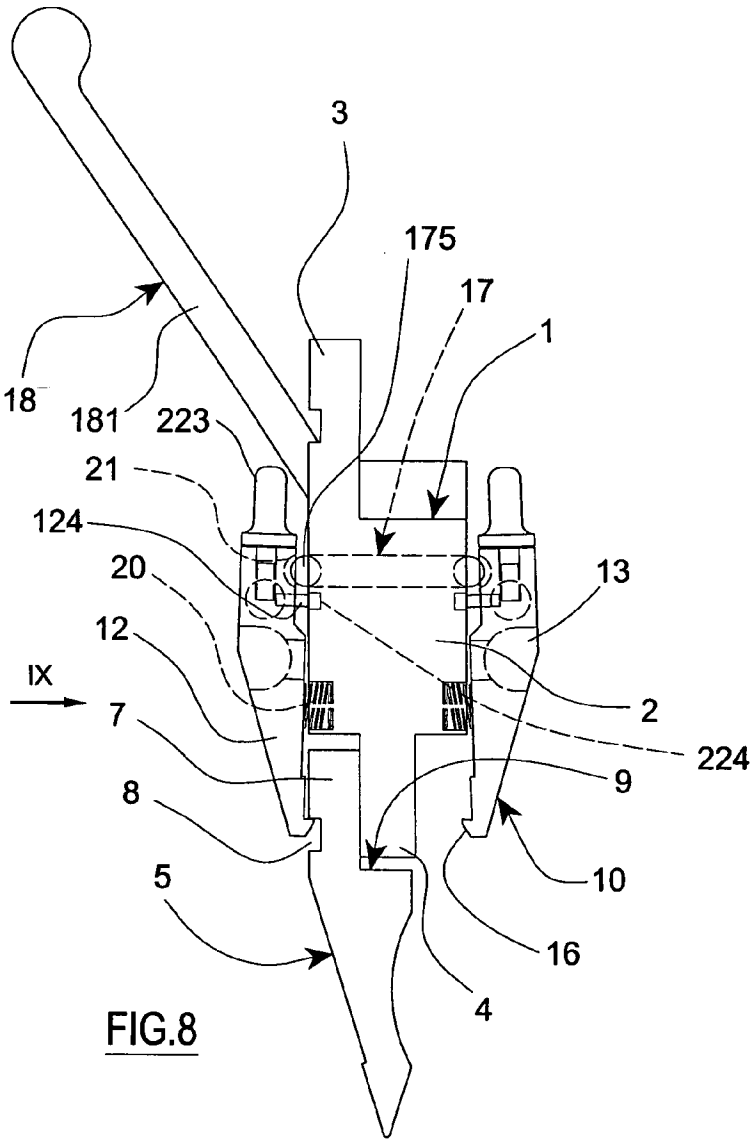
FIG. 8 is a view totally similar to FIG. 7, in a different operative configuration.
Figure 11:
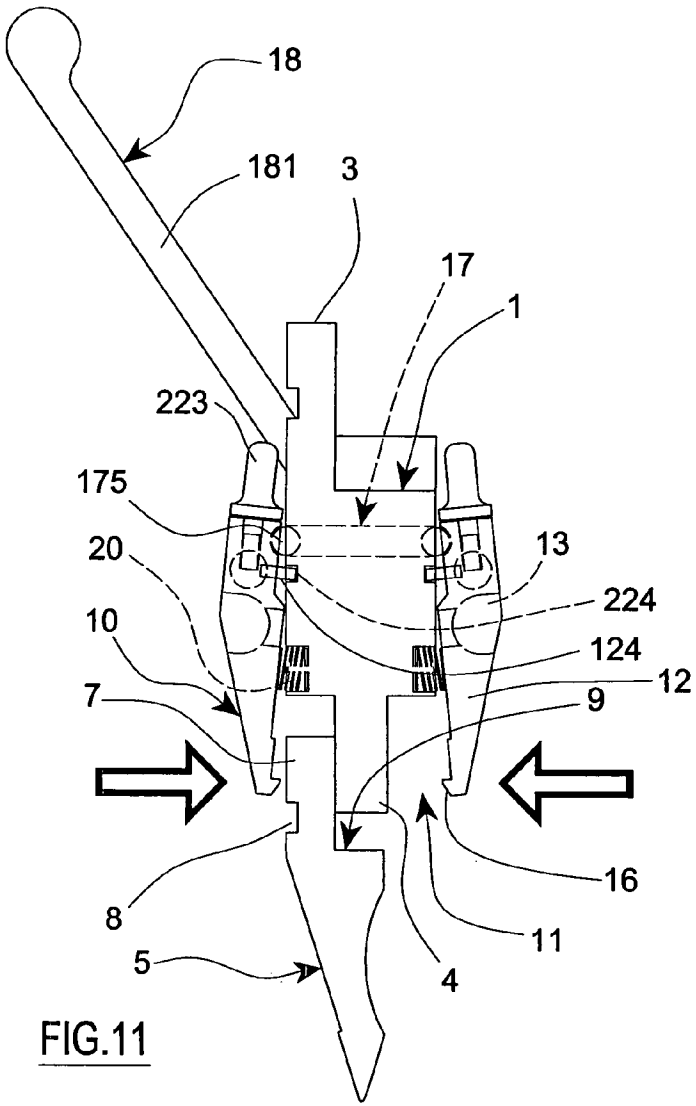
FIG. 11 is a view obtained in the direction XI indicated in FIG. 10.

Said bar 1 comprises a central core 2 which at its top presents a full-length salient lateral rib 3 for fixing said bar 1 to said crosspiece, and at its bottom presents a full-length descending central rib 4 against which the tool 5 is intended to be locked (see FIGS. 7, 8 and 11).

The tool 5 comprises (FIG. 7) a lower blade or knife 6, and an overlying shank 7 having, on one side, a full-length lateral groove 8, and on the other side a step-shaped recess 9 intended to receive the rib 4 of the bar or adaptor 1.

In front of the rib 4 there is a clamping plate 10 positioned on the bar 1, and which together with said rib 4 defines a groove 11 for receiving and locking the shank 7 of the tool 5.

Essentially the rib 4 and clamping plate 10 define a sort of clamp or gripper.

It should be noted that the plate 10 is divided into several parts or jaws 12, two in number in the illustrated example (FIGS. 1, 2, 5, 9 and 10), and that the tool 5 is of modular or sectional type, i.e. it comprises a series of sectors usually of different length.

The tool 5 and hence also the plate 10 can be arranged on one or the other side of the rib 4 as is easily apparent from FIGS. 1, 2, 5, 7, 8 and 11.

Each jaw 12 is hinged to the core 2 of the bar 1 in the manner of a rocker arm.

For this purpose it presents two side-by-side transverse holes 13 (FIGS. 1, 2, 9 and 10) of different cross-sections (FIGS. 7, 8 and 11) which receive with a certain radial slack two screws 14 which are screwed down into respective threaded holes 13 (FIG. 2) in the core 2, but are not tightened against the jaw 12.

Specifically, said screws 14 are of the spherical head type, i.e. they present at the base of their head a neck of curved cross-section which engages a matching cradle in the respective hole 13 (FIGS. 7, 8 and 11).

At the base of the jaw 12 there is a full-length internal anti-withdrawal tooth 16 arranged to engage a groove 8 in the tool 5 (FIGS. 7–8).

Figure 5:
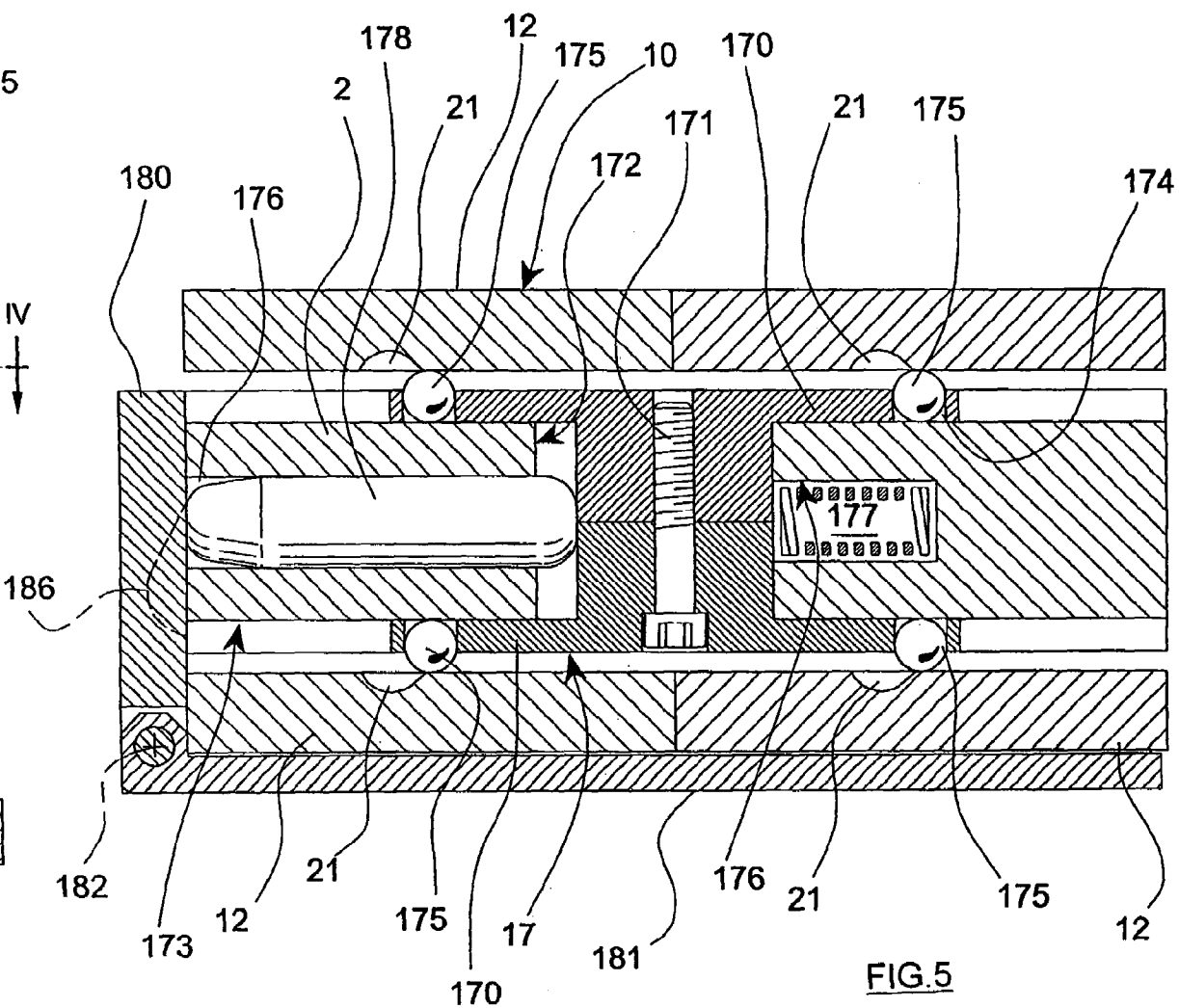
FIG. 5 is the section V—V of FIG. 1.

The jaw 12 is closed by a mobile assembly or slider, indicated overall by 17 in FIGS. 2 and 5, which is under the control of a unit indicated overall by 18 in FIG. 2 and comprising an articulated operating lever 181.

The slider 17 comprises two identical profiled pieces 170 of T-shape (FIG. 2) joined together by a screw 171 to form an H-shaped flat component (FIG. 5).

The crosspiece of said H profile is slidingly received, as an exact fit, in a longitudinally extending transverse slot 172 provided in the bar 1 (FIG. 5), its arms lying in matching grooves 173 which extend along the sides of the core 2 and are connected together by said slot 172.

The outer faces of said arms are flush with the sides of the core 2 (FIG. 5), at the end of each arm there being provided a through hole 174 into which a ball 175 of diameter exceeding the depth of the groove 173 is inserted as an exact fit.

At the base of each side of the core 2 there is a series of cavities 19, two for each jaw 12 (FIG. 2), which house respective compression springs 20.

Said springs 20 press against the lower end of the jaw 12 such as to maintain the upper end of said jaw 12 constantly urged elastically against said ball 175.

In the inner face of the upper end of the jaw 12 there is also provided a cavity 21 intended to engage the ball 175 (FIGS. 5, 8 and 11).

The core 2 presents a longitudinal dead hole 176 lying between the grooves 173 (FIG. 2) and traversing the slot 172 (FIG. 5).

A compression spring 177 is inserted into the bottom of said hole 176 to act against the crosspiece of said H profile of the slider 17, into the opposite end there being inserted a pushrod 178 which is positioned between said crosspiece and the rear end of the lever 181 forming part of the unit 18.

The opposing ends of the pushrod 178 are convex (FIG. 5).

The lever 181 is hinged to the component 180 by a pin 182 positioned perpendicular to the bar 1.

The component 180 is in the form of a profiled plate, the lever 181 comprising a handgrip.

The component 180 is hinged to one end of the core 2 by a pin 183 which is parallel to the bar 1, from the core 2 there branching a second pin 184 (FIGS. 1 and 2) which passes through an arched slot 185 provided in the component 180.

The centre of curvature of the slot 185 lies on the axis of the pin 183, saidslot 185 defining the range of rotation of the lever 181.

Figure 3:
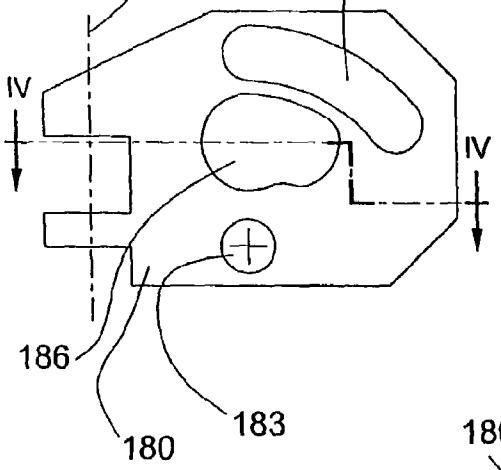
FIG. 3 is a view in the direction III of FIG. 2.
Figure 4:
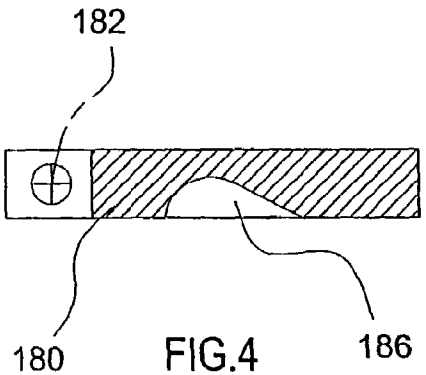
FIG. 4 is the section IV—IV of FIG. 3.

As shown in FIGS. 3 and 4, in that face of the component 180 facing the core 2 there is a cavity 186 with which the facing or proximal convex end of the pushrod 178 is arranged to engage (FIG. 5).

In plan view, the profile of the cavity 186 is bean-shaped (see FIG. 3), its centre of curvature lying on the axis of the pin 183, and its base providing an inclined surface (FIGS. 4 and 5) for the sliding of said facing convex end of the pushrod 178.

To insert and extract the shank 7 of the tool 5 into, and from the groove 11 of the adaptor 1 the following means are provided (FIG. 7).

In the upper part of each jaw 12 there is provided a longitudinal dead hole 22 (FIGS. 2 and 6) from which two longitudinal slots indicated by 23 (FIG. 2) and 24 (FIG. 6) extend towards the upper edge and the inner face of the jaw 12 respectively.

Figure 6:
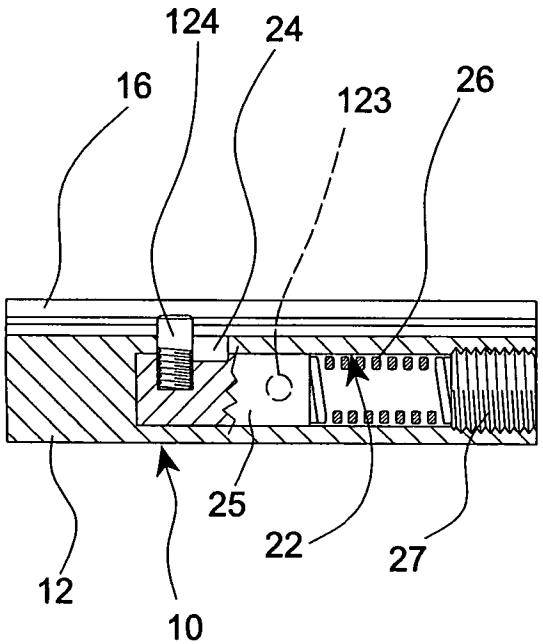
FIG. 6 is the section VI—VI of FIG. 2.

Starting from its base, each hole 22 houses, in succession, a pin 25, a compression spring 26, and a threaded abutment plug 27 (FIGS. 2 and 6).

The pin 25 presents first 124 and second 123 pegs which are transverse to each other and are slidingly inserted into the transverse slots 24 and 23 respectively (FIG. 1 and FIG. 6).

The first pegs 124 (FIG. 6) passes beyond the inner face of the jaw 12, to be able to engage (FIG. 11) the respective engagement seat 224 (FIG. 2) of the core 2, the second pegs 123 carrying an operating head 223.

Figure 9:
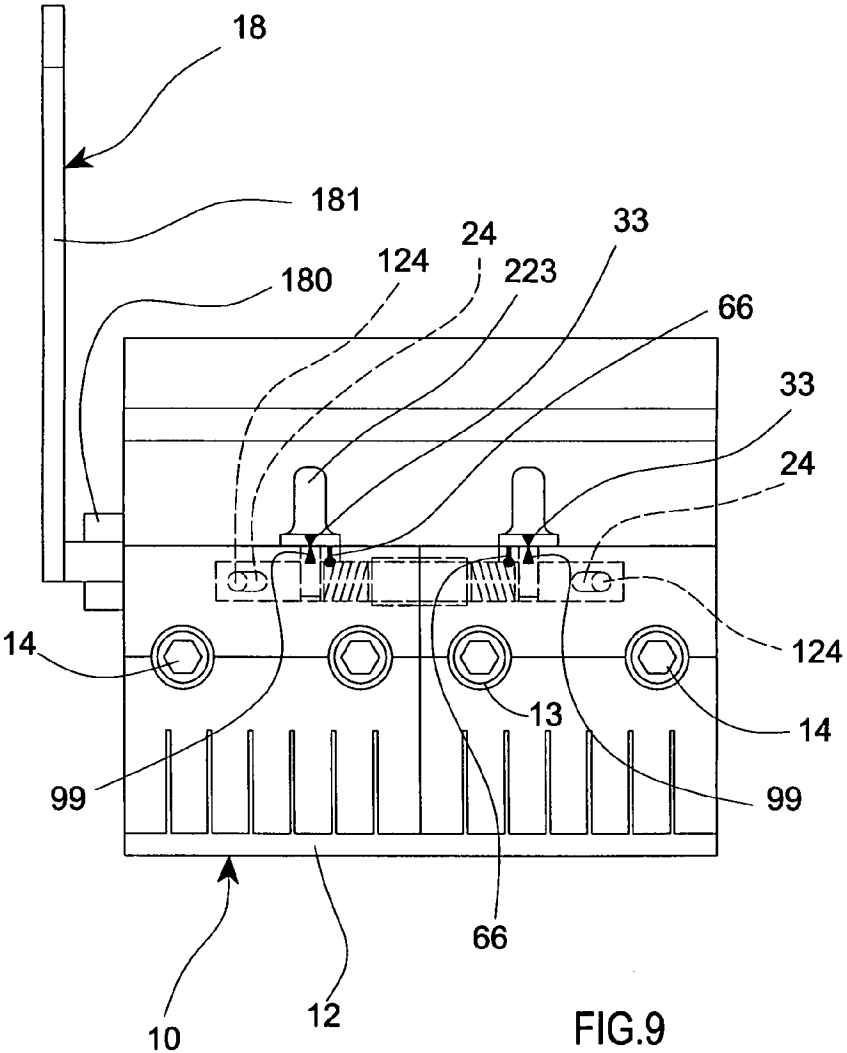
FIG. 9 is the view obtained in the direction IX indicated in FIG. 8.

Finally, the head 223 presents a pointer 33 with which two reference marks 66 and 99 on the outer face of the jaw 12 correspond (FIGS. 9 an 10).

The aforedescribed unit operates substantially as follows.

When the tool 5 is working, the unit 18 with the articulated lever 181 is in its rest configuration shown in FIG. 1.

Specifically, the component 180 and the lever 181 comprising the unit 18 lie at a right angle to each other; the hinge pin 182 between said two parts 180 and 181 is orientated vertically; and the handgrip of the lever 181 is positioned against the upper vertical band of the jaw 12 (see FIGS. 1 and 5).

In addition, the pushrod 178 of the slider 17 is in contact with a point of the component 180 which is outside the cavity 186 (FIG. 5), so that the balls 175 carried by the slider 17 lie outside the respective cavities 21 (FIG. 5) and act against the jaws 12 in such a manner as to clamp them against the shank 7 which rests against the lower face of the rib 4 (FIG. 7).

At the same time the pointers 33 of the heads 223 are aligned with the reference marks 99 (FIG. 9) by the effect of the springs 26 (FIG. 6). If the tool 5 is merely to be loosened, for example to adjust its position along the groove 11, the component 180 and the lever of the unit 18 are firstly aligned as shown in FIG. 7, and then rotated upwards.

This rotation (FIG. 8) of the lever 181 causes the cavity 186 to align with the pushrod 178 (FIGS. 5 and 8), which slides towards the component 180 by the effect of the spring 177 (FIG. 5), whereas the balls 175 of the slider 17 enter the cavities 21 (FIG. 8), by which the jaws 12 open by the effect of the springs 20.

Said opening is not complete (FIG. 8), but is limited by the pegs 124 which rest against the facing flat surface of the core 2.

By virtue of said limited opening, the shank 7 of the tool 5 slightly withdraws from the groove 11, and remains hanging from the tooth 16 of the jaw 12 by virtue of its groove 8 (FIG. 8).

At this point the shank 7 can be adjusted along the groove 11, evidently under conditions of maximum safety.

If at least one part of the tool 5 has to be removed, then the operator using one hand makes the heads 223 approach to align the pointers 33 with the reference marks 66 (FIG. 10), and with the other hand supports said at least one part of the tool from below.

Figure 10:
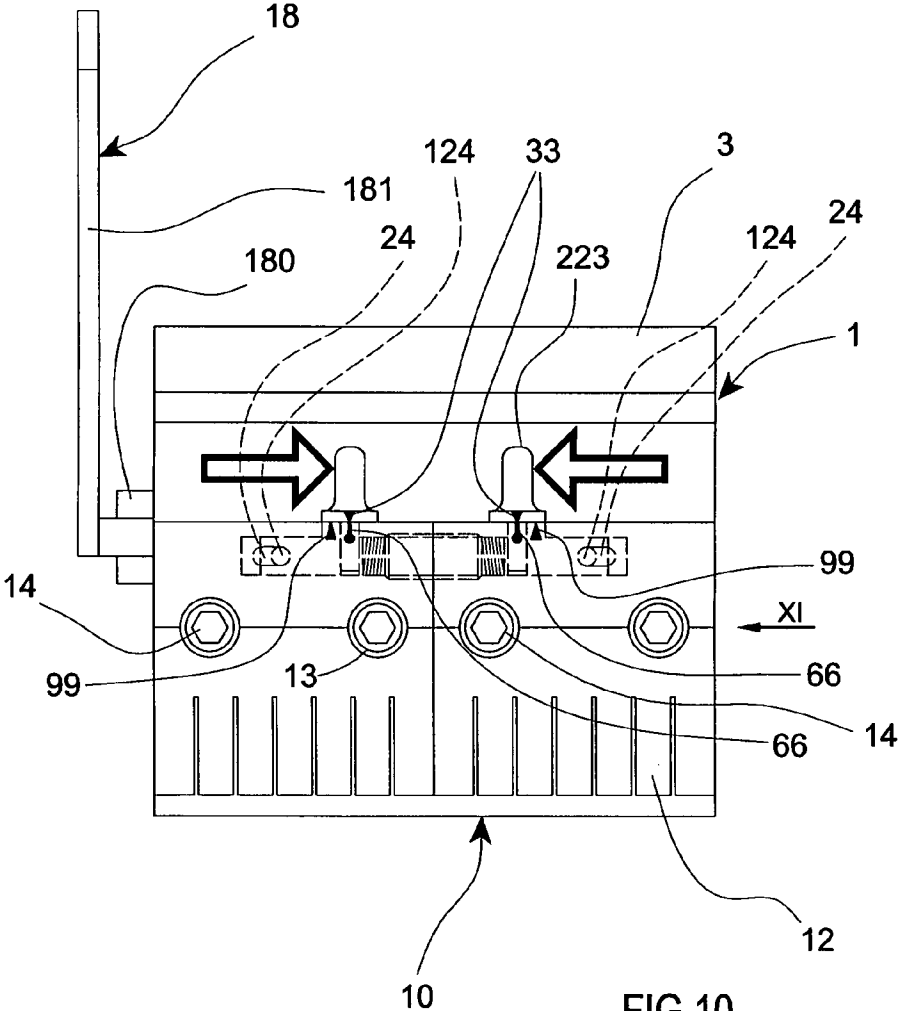
FIG. 10 is a view totally similar to FIG. 9, in a different operative configuration.

This mutual approach of the heads 223, indicated by two opposing arrows in FIG. 10, results in compression of the springs 26 (FIG. 6); insertion of the pegs 124 into the holes 224 (FIG. 11) by the effect of the opening springs 20 for the jaw 12; and the consequent complete opening of the jaw 12, to release the shank 7 as shown in FIG. 11.

After the tool 5 has been subjected to whatever action is required, the operator proceeds in the reverse order to render it operative.

Specifically, he supports the tool 5 with one hand while with the other hand he brings the pointers 33 into alignment with the reference marks 99. To achieve said alignment, the lower end of the jaw 12 is pressed to overcome the thrust of the springs 20, as indicated by two opposing arrows in FIG. 11, by which the springs 26 withdraw the pegs 124 (FIG. 9) as soon as these latter emerge from the holes 224 (FIG. 8). Having done this the lever 181 is rotated into the horizontal position of FIG. 7, by which the slider returns into the position of FIG. 5, where by means of the balls 175 it clamps the jaw 12 against the shank 7 (FIG. 5).

Finally the lever 181 is rotated through a right angle as shown in FIGS. 1 and 5.

What is claimed is:

1. A toolholder unit for sheet metal bending brakes, comprising a bar (1), having a core (2), to be associated with a fixed or movable part of the brake which is provided with at least one recess (9) forming with a jaw (12) associated therewith a groove (11) to receive the shank (7) of the tool (5), there being provided elastic means (20) for maintaining said jaw spaced from said recess and from the shank contained therein, and locking means for clamping said jaw against said shank, wherein said locking means comprise at least one slider (17) axially slidable within a seat facing that side of the bar (1) facing the jaw, at least a ball (175) projecting from said slider beyond that side of the bar facing the jaw; at least one cavity (21) provided in the jaw (12), to receive said ball (175), and means (18) for causing said slider (17) to undergo controlled translations relative to said bar (1).

2. A unit as claimed in claim 1, wherein means (223) for causing the jaw to undergo maximum opening thereof are installed on the jaw for causing the jaw to undergo maximum opening.

3. A unit as claimed in claim 2, wherein said means (223) for causing the jaw to undergo maximum opening thereof comprise a rod slidingly mounted in a longitudinal seat in the jaw, said seat opening to the outside via a first slotted aperture from which there emerges a peg facing the bar, and via a second slotted aperture from which there projects an operating head at the disposal of the user, said peg being arranged to slide between a rest position, established by an elastic thrust means acting on the rod, where it faces a flat region of the bar, and a working position chosen by the user, in which the said peg is positioned in front of a matching sunken region of the bar.

4. A unit as claimed in claim 1, wherein said core (2) is provided with a longitudinally extending transverse slot in which is slidingly received the slider.

5. A unit as claimed in claim 1, wherein said slider comprises two identical profiled pieces (170) of T-shape joined together by a screw (171) to form an H-shaped flat component.

6. A unit as claimed in claim 5, wherein each arm of said H-shaped slider is respectively received in matching grooves which extend along the sides of the core.

7. A unit as claimed in claim 6, wherein each said arm of said H-shaped slider is provided with a through hole (174) into which is received said ball.

8. A unit as claimed in claim 1, wherein said means (18) for causing said slider (17) to undergo controlled translations relative to said bar (1) includes a component (180) pivoted on the bar, said component being provided with a bean-shaped cavity, and a pushrod (178), received in a dead hole of the core of the bar, said pushrod having an end engaging with a portion of said slider, and the opposite end engaging with the bean-shaped cavity of said component.

9. A unit as claimed in claim 8, wherein said component comprises an operating handgrip which is hinged to said component on an axis perpendicular to that of the bar such that said component and said handgrip are able to assume a first rectilinear position in which the axis of the handgrip is perpendicular to that of the bar, and a second folded position in which the axis of the handgrip is parallel to that of the bar.

10. A unit as claimed in claim 8, characterized in that the pushrod is constantly urged elastically against the bean-shaped cavity.

* * * * *